US006155018A

United States Patent [19]

Yang

[11] Patent Number: 6,155,018

[45] Date of Patent: Dec. 5, 2000

[54] STAFF STRUCTURE WITH A FLAG ELEVATING DEVICE

[76] Inventor: Tsui Hua Yang, P.O. Box 82-144, Taipei, Taiwan

[21] Appl. No.: 09/223,795

[22] Filed: Dec. 31, 1998

[51] Int. Cl.[7] ..... E04C 3/30

[52] U.S. Cl. ..... 52/736.4; 52/736.1; 116/174

[58] Field of Search ..... 116/173, 174; 52/720.1, 726.1, 726.4, 736.1, 736.4

[56] References Cited

U.S. PATENT DOCUMENTS

| | | | |
|---|---|---|---|
| 3,706,297 | 12/1972 | Voorhees | 116/174 |
| 3,923,001 | 12/1975 | Murdock | 116/173 |
| 4,972,794 | 11/1990 | Smyly | 116/173 |
| 5,168,828 | 12/1992 | Smyly | 116/173 |
| 5,253,608 | 10/1993 | Burke | 116/173 |
| 5,509,371 | 4/1996 | Phillips | 116/173 |
| 5,809,930 | 9/1998 | Brooks | 116/174 |
| 5,975,009 | 11/1999 | Nihra | 116/73 |
| 6,018,926 | 2/2000 | Chen-Chao | 52/736.1 |

*Primary Examiner*—Beth A. Stephan
*Attorney, Agent, or Firm*—A & J

[57] ABSTRACT

A staff structure with a flag elevating device includes an I-shaped inner fitting tube, an outer fitting tube, a hanging pole carrying a flag, a staff; and a halyard. The inner fitting tube has upper and lower projecting portions at upper and lower ends thereof. The projecting portions are provided with symmetrical hook ears and through holes on one side thereof. The inner fitting tube is enclosed by the outer fitting tube. Upper and lower ends of the outer fitting tube are provided with clamp rings for holding the hanging pole. After the inner fitting tube is fitted to the staff, the halyard is tied to the hook ears of the inner fitting tube and passed round a pulley at a top end of the staff. Pulling of the halyard causes the flag to be hoisted or lowered. The outer fitting tube is capable of turning with respect to the inner fitting tube to prevent the flag from getting entangled on the staff.

5 Claims, 8 Drawing Sheets

STAFF STRUCTURE WITH A FLAG ELEVATING DEVICE

BACKGROUND OF THE INVENTION

1. Field of the Invention

The present invention relates to a staff structure with a flag elevating device, more particularly to a staff structure that allows free elevation of the flag and that prevents the flag from getting entwined on the staff.

2. Description of the Prior Art

In a conventional staff structure, a top end of the staff is provided with a pulley, and a halyard is passed round the pulley. A flag is tied to the halyard. By pulling the halyard, the flag can be hoisted or lowered. However, in a structure as such, the flag is secured at only one point. When the wind is strong, hoisting or lowering of the flag becomes inconvenient. Besides, after the flag has been hoisted to the top end of the staff, the flag may easily get entwined on the staff by the wind, which is very unsightly.

SUMMARY OF THE INVENTION

A primary object of the present invention is to provide a staff structure with a flag elevating device. A staff structure with a flag elevating device according to the present invention includes an I-shaped inner fitting tube, an outer fitting tube, a hanging pole carrying a flag, a staff, and a halyard. The inner fitting tube has upper and lower projecting portions at upper and lower ends thereof. The projecting portions are provided with symmetrical hook ears and through holes on one side thereof. The inner fitting tube is enclosed by the outer fitting tube. Upper and lower ends of the outer fitting tube are provided with clamp rings for holding the hanging pole. After the inner fitting tube is fitted to the staff, the halyard is tied to the hook ears of the inner fitting tube and passed round a pulley at a top end of the staff. Pulling of the halyard causes the flag to be hoisted or lowered. The outer fitting tube is capable of turning with respect to the inner fitting tube to prevent the flag from getting entangled on the staff.

Another object of the present invention is to provide a staff structure with a flag elevating device, in which an outer fitting tube is capable of turning with respect to an inner fitting tube such that a flag can turn with respect to a staff so that the flag will not easily become entwined on the staff when the wind is strong.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
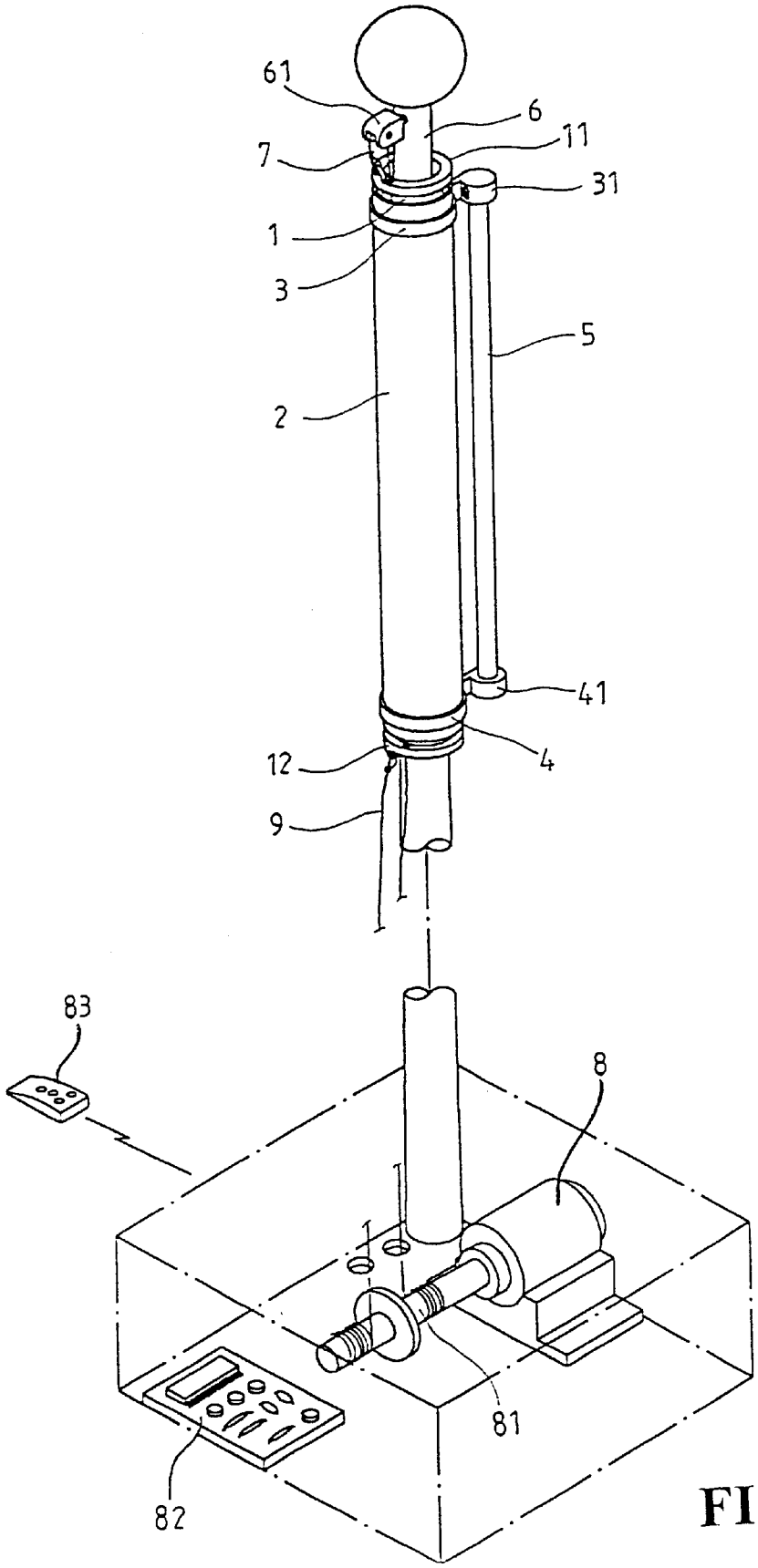
FIG. 1 is a perspective schematic view of a first preferred embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
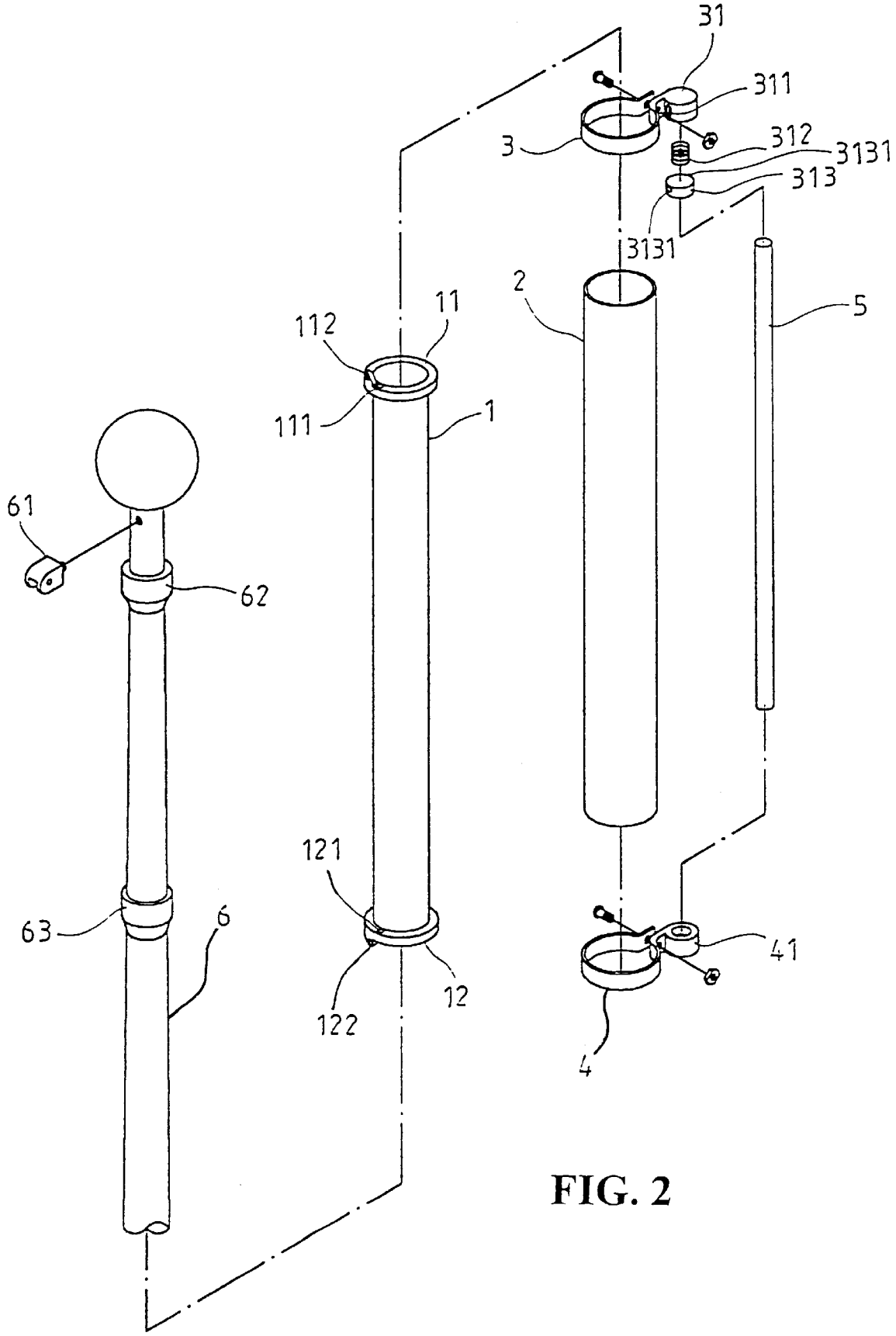
FIG. 2 is a perspective exploded schematic view of the first preferred embodiment of the present invention.

With reference to FIGS. 1 and 2, the present invention essentially comprises an inner fitting tube 1 having a shape of a numeral "1", an outer fitting tube 2, upper and lower clamp rings 3, 4, a hanging pole, a staff 6, a first halyard 7, a motor 8, a second halyard 9.

The inner fitting tube 1 is enclosed by the outer fitting tube 2. Upper and lower ends of the outer fitting tube 2 are provided with symmetrical clamp rings 3, 4 respectively. One end of each of the clamp rings 3, 4 is connected to an upper (lower) fitting seat 31 (41). The upper fitting seat 31 of the upper clamp ring 3 is provided with a slide groove 311, and a spring 312 is installed in the upper fitting seat 31. After installation of the spring 312, a packing piece 313 having projecting ribs 3131 on both sides thereof is fitted above the spring 312, so that the packing piece 313 may, due to the provision of the ribs 3131, slide along the slide groove 311 upwardly or downwardly to facilitate fitting of both ends of the hanging pole 5 into the respective fitting seats 31, 41. After a flag is attached to the hanging pole 5, the inner fitting tube 1 is fitted into the staff 6, and the first halyard 7 is tied to an upper hook ear 112 at an upper end thereof, so that the first halyard 7 can pass around a pulley 61 at a top end of the staff 6 into upper and lower through holes 111, 121 of the inner fitting tube 1 to wind around a drive shaft 81 of the motor 8. The inner fitting tube 1 further has a lower hook ear 122 to which the second halyard 9 is tied. The second halyard 9 is wound on the drive shaft 81 of the motor in various directions so that when the motor 8 is actuated by a circuit 82 using a remote control 83, the positive and reverse rotation of the motor 8 can cause the lifting or lowering of a flag 100.

Figure 3:
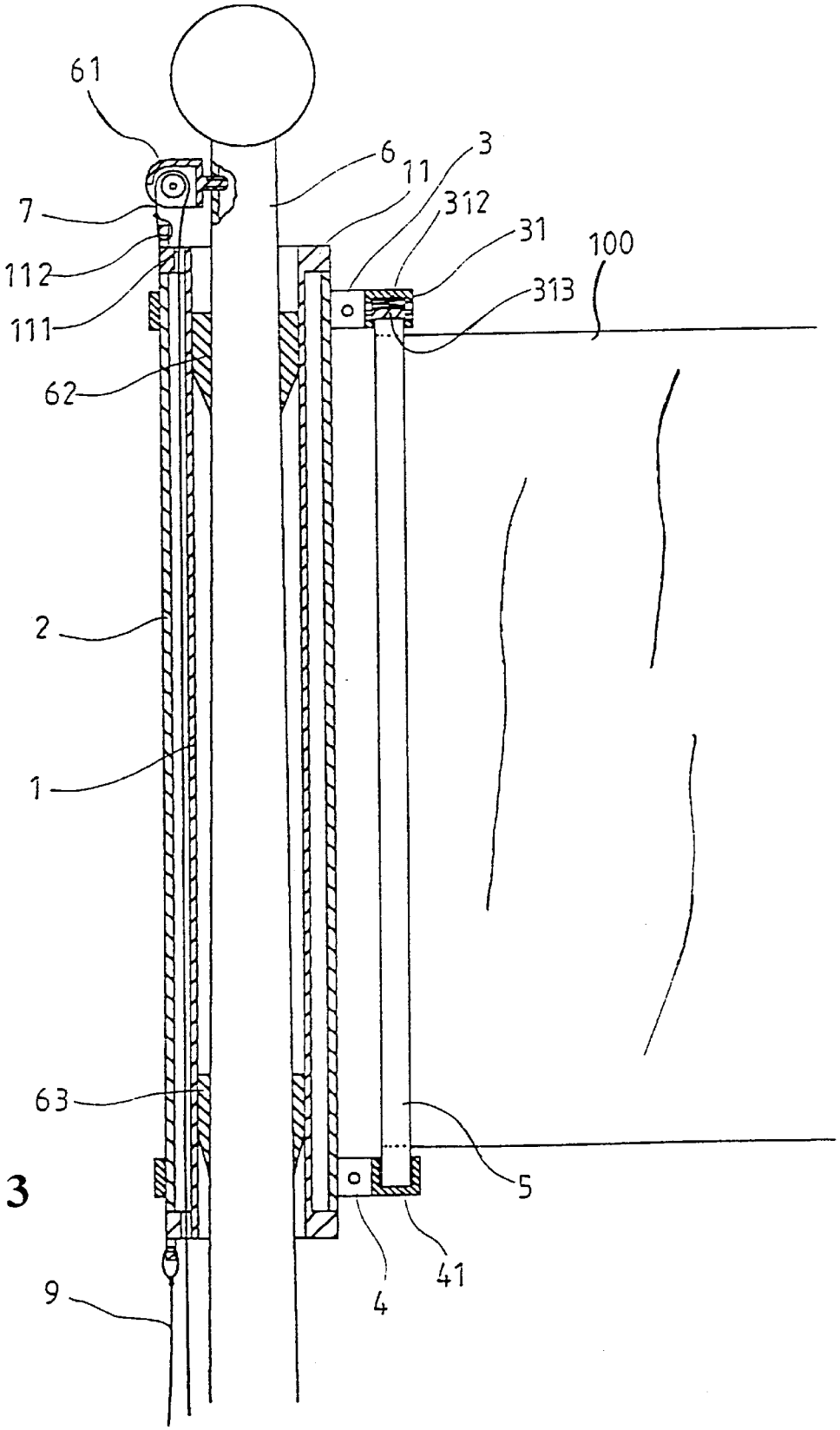
FIG. 3 is a sectional schematic view of the first preferred embodiment of the present invention.

Referring to FIG. 3 in conjunction with FIG. 2, the halyards 7, 9 are respectively tied to the upper and lower hook ears 11 2, 122 of the inner fitting tube 1. The first halyard 7 passes round the pulley 61 and through the through holes 111, 121. Therefore, when the motor 8 rotates in a positive or reverse direction, the halyards 7, 9 will cause the inner fitting tube 1 to elevate or lower, thereby bringing the flag 100 on the hanging pole 5 to elevate or lower. Since the outer fitting tube 2 is fitted over the inner fitting tube 1, when the flag 100 waves in the wind, the outer fitting tube 2 will turn along the inner fitting tube 1 to prevent the flag 100 from twining round the staff 6.

In general, a conventional staff has a slender upper portion. In the present invention, upper and lower positioning sleeves 62, 63 having bottom ends thereof slanting inwardly are provided on the upper portion of the flag 6 at suitable positions such that the upper positioning sleeve 62 is slightly larger than the lower positioning sleeve 63, so that when the inner fitting tube 1 slides to the upper portion of the staff 6, it can be prevented from being loosened by the positioning sleeves 62, 63.

Figure 4:
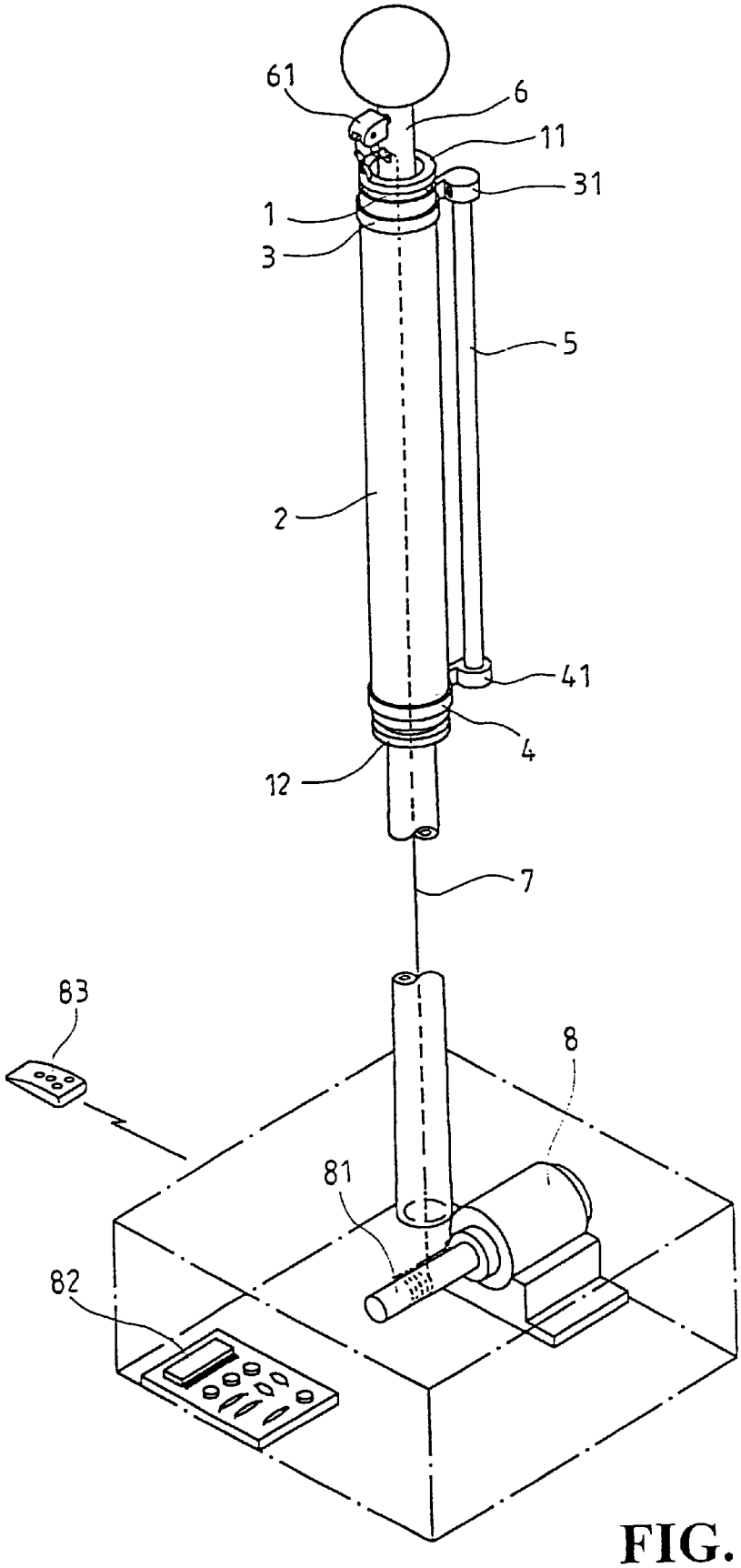
FIG. 4 is a schematic view of a second preferred embodiment of the present invention.

Referring to FIG. 4, one end of the first halyard 7 that is tied to the upper hook ear 112 may go longitudinally through the staff 6 with the other end thereof being wound on the drive shaft 81 of the motor 8 so that when the motor 8 rotates in a positive or reverse direction, elevation or lowering of the flag 100 can also be accomplished.

Figure 5:
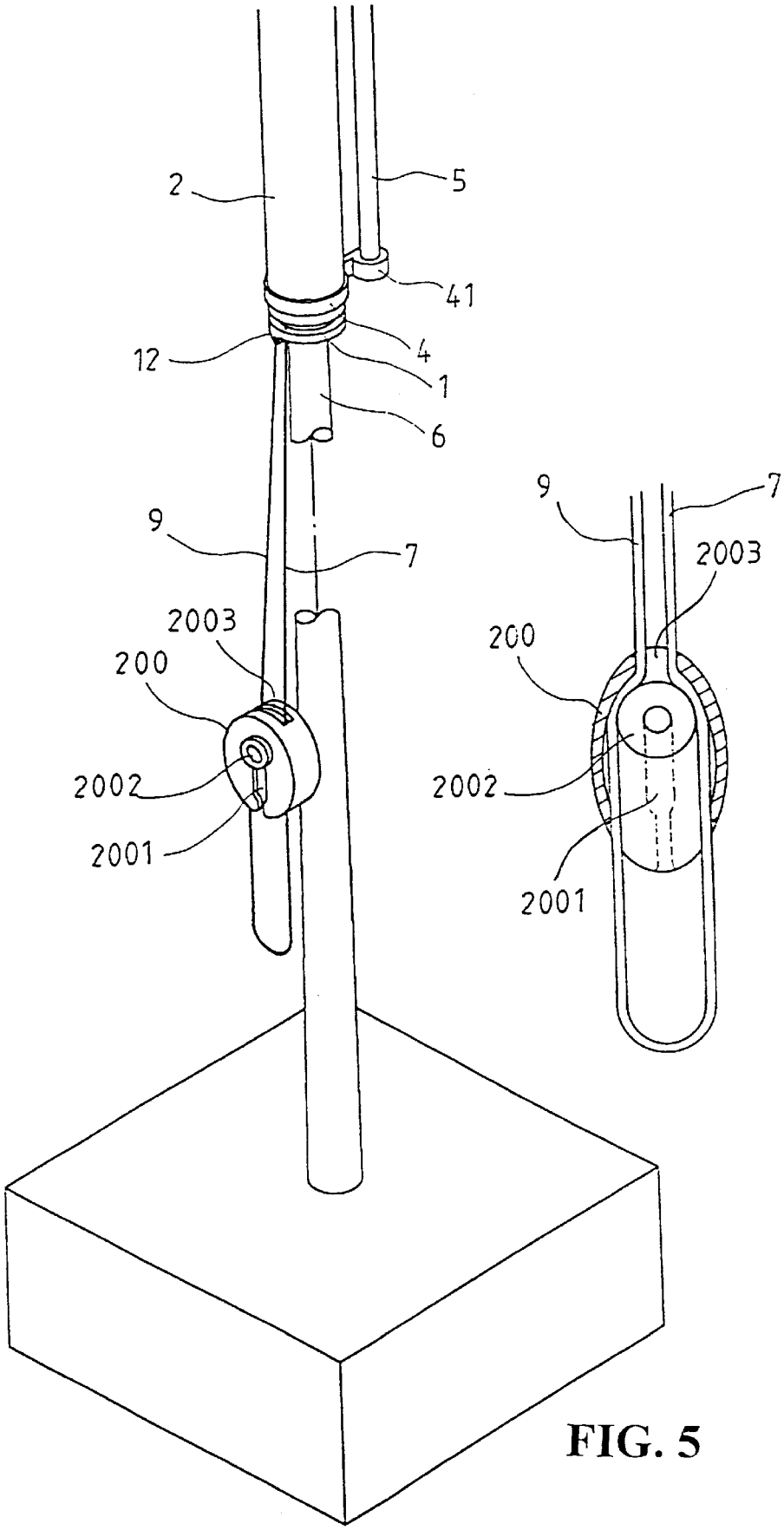
FIG. 5 is a schematic view of a third preferred embodiment of the present invention, showing a halyard securing structure.

As shown in FIG. 5, a securing seat 200 is provided at the bottom end of the staff 6. The securing seat 200 is provided with a slide track 2001, a positioning wheel 2002, and an opening 2003 at an upper end thereof. The halyards 7, 9 are passed through the opening 2003 to push the positioning wheel 2002 upwardly so that the halyards 7, 9 are secured on the inner edges of the securing seat 200. Certainly, the present invention may also employ a spiral spring (spiral power spring) to store power so as to achieve free lifting and lowering of the flag 100.

Figure 6:
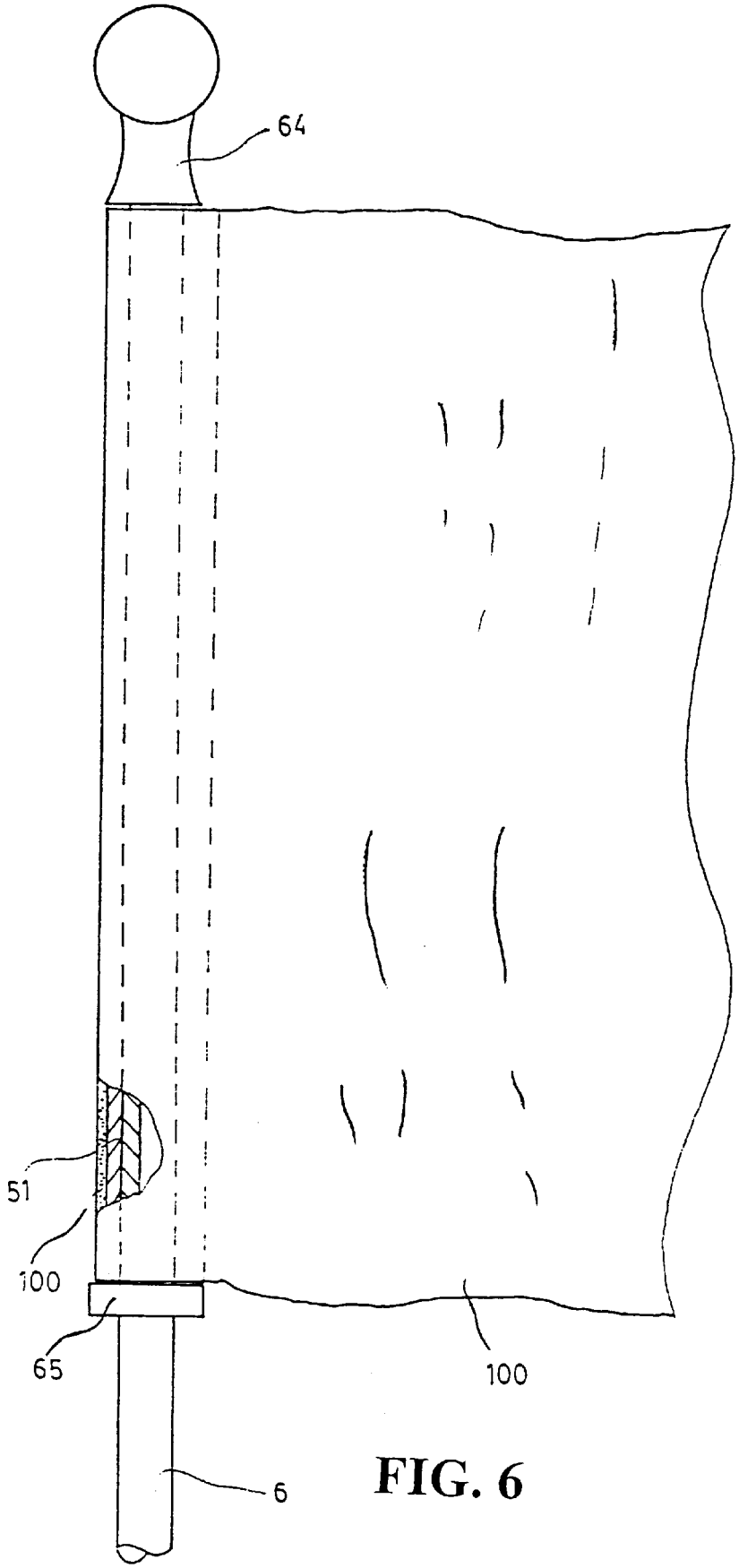
FIG. 6 is a schematic view of a fourth preferred embodiment of the present invention, showing another halyard securing structure.

With reference to FIG. 6, which shows another embodiment of the present invention, this embodiment mainly comprises a hollow fitting tube 51 with a flag 100 sewed thereto, and the hollow fitting tube 51 is directly fitted on the staff 6 in loose fit. Two upper and lower securing elements 64, 65 are fixedly provided on the staff 6 at upper and lower ends thereof so that the flag 100 cannot displace upwardly or downwardly and is therefore positioned. Hence, the hollow fitting tube 51 can turn along the circumference of the staff 6 when the flag 100 is blown by the wind, and the flag 100 will not become entwined on the staff 6.

Figure 7:
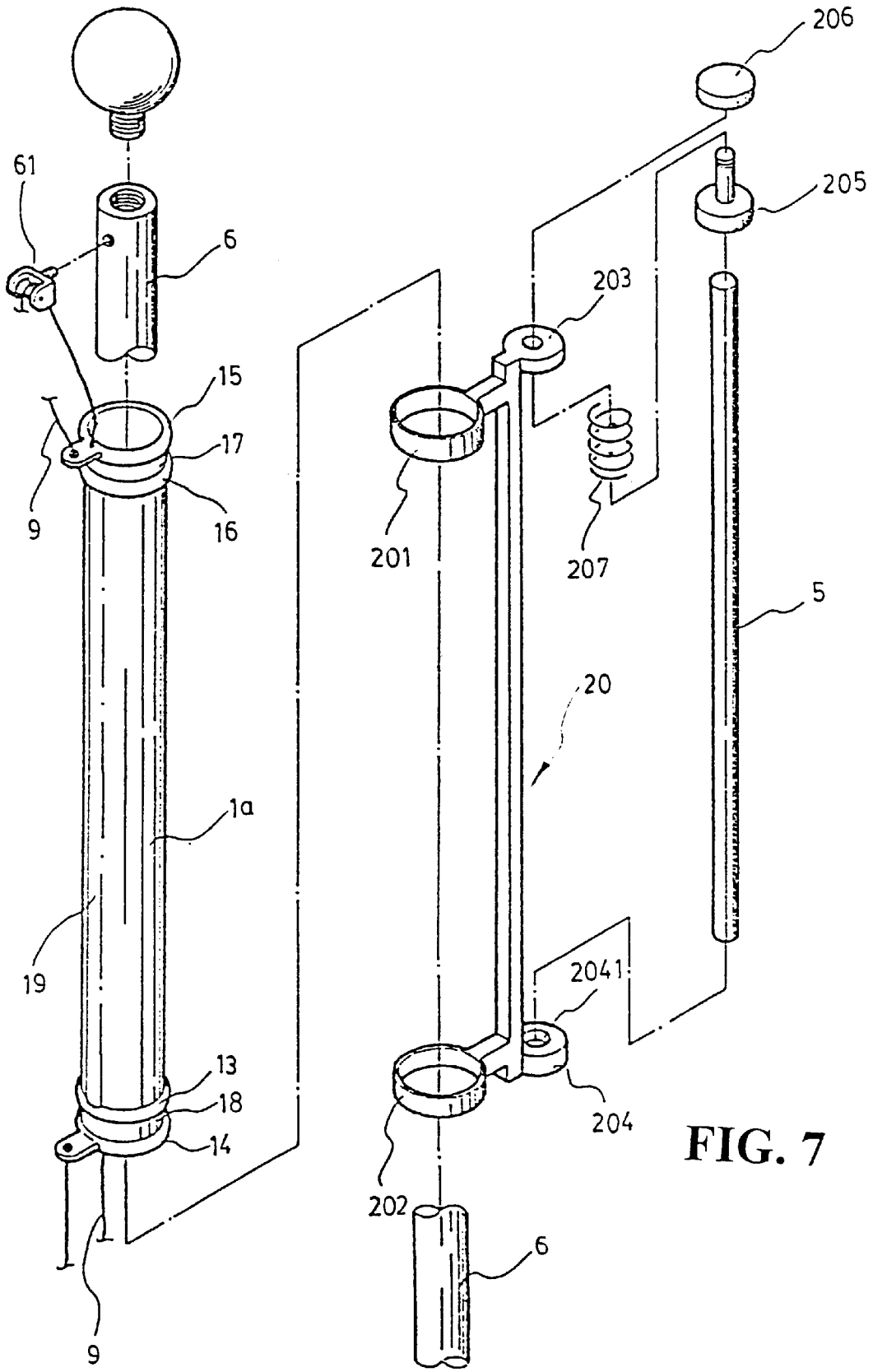
FIG. 7 is a perspective exploded schematic view of a fifth preferred embodiment of the present invention.
Figure 8:
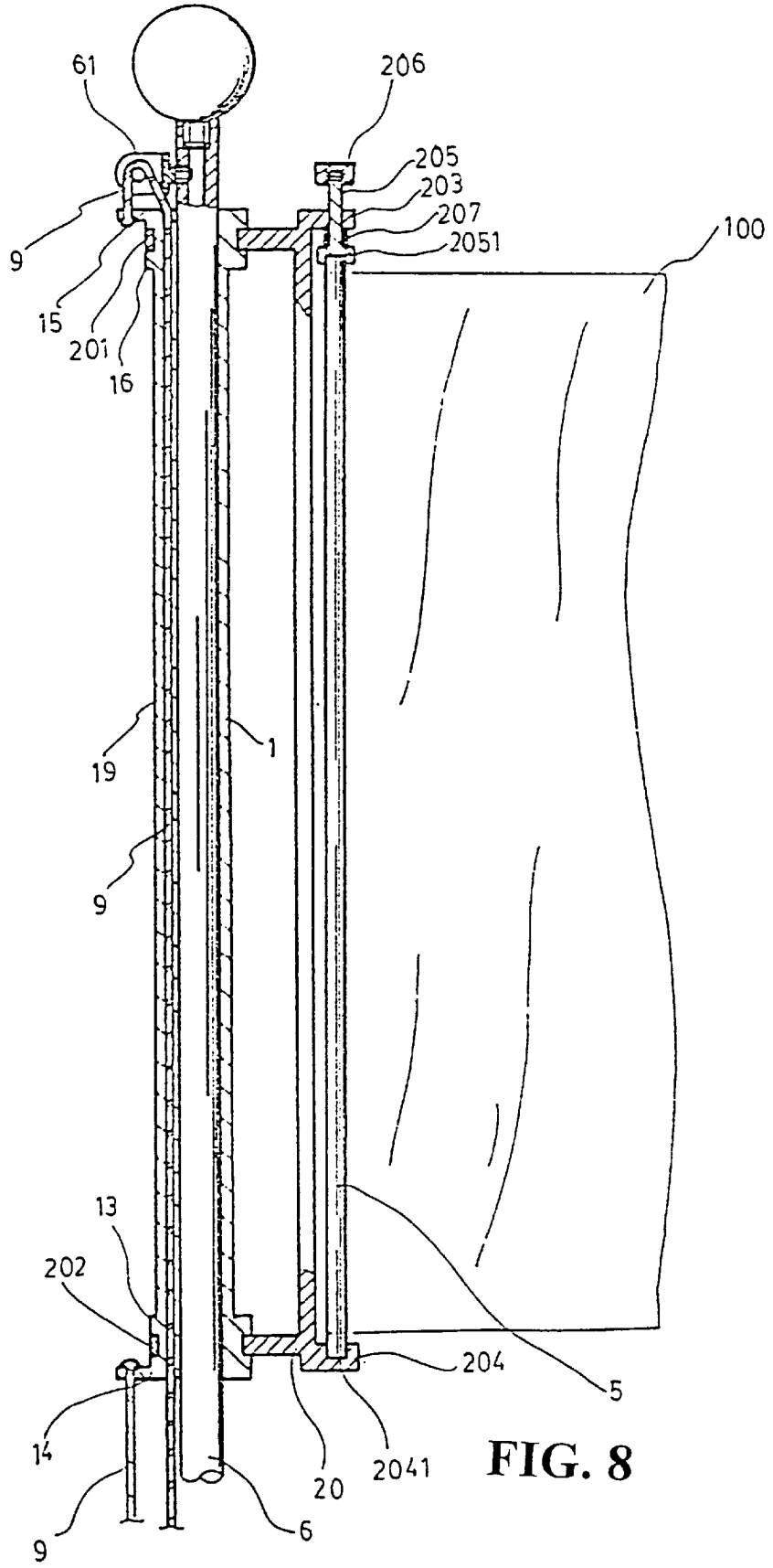
FIG. 8 is an assembled schematic view of the embodiment of FIG. 7.

With reference to FIGS. 7 and 8, which show a further embodiment of the present invention, this embodiment includes a hollow elongated fitting tube that is provided with two smooth and round flanges 15, 16 and 13, 14 on upper and lower sides thereof respectively so as to define two annular slide grooves 17, 18 of a suitable width. A flag mount 20 is provided with fitting rings 201, 202 at upper and lower ends of one side thereof at positions corresponding to the slide grooves 17, 18. As the fitting rings 201, 202 are made of a plastic material that has a suitable elasticity, they can be fitted directly onto the slide grooves 17, 18 of the elongated fitting tube 1*a* and can turn slidably along the slide grooves 17, 18. On the other side of the flag mount 20 at upper and lower ends thereof, there are respectively provided an elastic retaining seat 203 having a central through hole and a securing supporting seat 204 having a central recess 2041. There is further provided a retaining post 205 that includes a base portion having a depression 2051 at a bottom side thereof and a post portion that extends upwardly from the base portion. The post portion of the retaining post 205 is inserted into the through hole of the retaining seat 203, and a retaining cap 206 is fitted top of the post portion projecting from the retaining seat 203. An elastic element 207 is fitted onto the post portion via the base portion so as to achieve an elastic state. A flag 100 is coupled to a hanging pole 5. The hanging pole 5 has a lower end inserted directly into the recess 2041 of the supporting seat 204, and an upper end inserted into the depression 2051 of the retaining post 205 by causing the retaining post 205 to displace slightly upward. The elasticity provided by the elastic element 207 causes the retaining post 205 to urges against the upper end of the hanging pole 5 so that the hanging pole 5 as a whole can be firmly secured. To dismantle the hanging pole 5, it is only necessary to pull the retaining post 205 upwardly so that the hanging pole 5 can be quickly disengaged from the flag mount 20.

The elongated fitting tube 1*a* is chiefly fitted on a staff 6. The staff 6 includes a finial and a pulley 61. One end of a halyard 9 is fixedly connected to a the flange 15 at the upper end of the elongated fitting tube 1*a* and passes in sequence round the pulley 61 and a channel 19 that projects from an outer circumference of the staff 6 along a longitudinal direction. A lower portion of the halyard 9 passes round a drive shaft of a motor, with the other end disposed on the flange 14 at the lower end of the elongated fitting tube l*a*.

When the flag 100 is blown by the wind, as the elongated fitting tube 1*a* is secured by the halyard 9 at upper and lower ends thereof, it is prevented from turning, so that the flag mount 20 and the hanging pole 5 connected thereto can turn along the circumference of the elongated fitting tube 1*a* to thereby achieve the same object of preventing the flag 100 from becoming entwined on the staff 6.

In summary, the present invention utilizes inner and outer fitting tubes that cooperate with clamp rings and a hanging pole to achieve free lifting and lowering of the flag and to prevent the flag from getting entangled on the staff. It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A staff structure with a flag elevating device, comprising:

an inner fitting tube that is generally I-shaped and that has upper and lower projecting portions, one side of said inner fitting tube at said upper and lower projecting portions being respectively provided with symmetrical hook ears and through holes for tying and passage of a halyard;

an outer fitting tube that encloses said inner fitting tube and that has upper and lower ends respectively provided with symmetrical clamp rings, one end of each of said upper and lower clamp rings being connected to a fitting seat for receiving a hanging pole adapted for hanging of a flag;

whereby said inner fitting tube is fit onto a staff, and said halyard is tied to said hook ears of said inner fitting tube and passed round a pulley at a top end of said staff so that by pulling said halyard, said flag can be hoisted or lowered, said outer fitting tube being capable of turning with respect to said inner fitting tube to prevent said flag from becoming entwined on said staff.

2. A staff structure with a flag elevating device as defined in claim 1, wherein said fitting seat of said upper clamp ring of said outer fitting tube has sides respectively provided with symmetrical slide grooves for installation of a spring, a packing piece having projecting ribs on both sides thereof being fitted above said spring so that said packing piece can slide along said slide grooves by means of said ribs, whereby said packing piece can displace upwardly and downwardly to facilitate fitting of said hanging pole.

3. The staff structure with a flag elevating device as defined in claim 1, wherein said staff has an upper end fitted with positioning sleeves that has a bottom portion slanting inwardly to prevent loosening of said inner fitting tube.

4. The staff structure with a flag elevating device as defined in claim 1, wherein said flag is sewed to said inner fitting tube, and said inner fitting tube is fitted to said staff in loose fit, said staff further having two securing elements fixedly provided on upper and lower sides thereof so that said flag cannot displace upwardly or downwardly.

5. A staff structure with a flag elevating device, comprising:

a fitting tube that is hollow and has upper and lower ends respectively provided with two smooth and round flanges so as to form two annular slide grooves of a suitable width, said fitting tube further having a channel projecting from an outer periphery thereof in a longitudinal direction for passage of a halyard;

a flag mount that is formed from a plastic material and has upper and lower ends, one side of said flag mount at said upper and lower ends being provided with fitting rings to correspond to said slide grooves of said fitting tube, the other side thereof at said upper and lower ends being provided with an elastic retaining seat and a securing supporting seat, said supporting seat being provided with a recess, said retaining seat having a central through hole for passage of a post portion projecting from a base portion of a retaining post, said post portion having a spring fitted thereon and a retaining cap fitted at an upper end thereof, said base portion having a bottom side provided with a depression; and a halyard that has one end secured to one of said flanges at said upper end of said fitting tube, said halyard passing round a pulley and said channel along one side of said fitting tube with a lower portion thereof passing round a drive shaft of a motor, and a lower end provided on one of said flanges at said lower end of said fitting tube.

* * * * *